US005718358A

United States Patent [19]

Long et al.

[11] Patent Number: 5,718,358

[45] Date of Patent: Feb. 17, 1998

[54] EXTENSIBLE CLOTHES HANGER

[75] Inventors: Nelson W. Long, Cave Creek; Reed C. Lowman, Phoenix; Charles S. Lord, Scottsdale, all of Ariz.

[73] Assignee: Sedo Trust, Lewes, Del.

[21] Appl. No.: 627,912

[22] Filed: Apr. 2, 1996

Related U.S. Application Data

[63] Continuation of Ser. No. 277,099, Jul. 20, 1994, abandoned.

[51] Int. Cl.[6] ..... A47G 25/40; A47G 25/44

[52] U.S. Cl. ..... 223/94; 223/89; 223/85

[58] Field of Search ..... 223/94, 89, 85, 223/92

[56] References Cited

U.S. PATENT DOCUMENTS

| | | | |
|---|---|---|---|
| 779,062 | 1/1905 | Beatty | 223/94 |
| 2,413,914 | 1/1947 | Fortner | 223/92 |
| 2,652,958 | 9/1953 | Alvord | 223/94 |
| 2,722,351 | 11/1955 | Dyer | 223/89 |
| 2,757,836 | 8/1956 | Niedermeyer et al. | 223/94 |
| 2,814,426 | 11/1957 | Miller | 223/94 |
| 3,168,970 | 2/1965 | Wilson | 223/92 |
| 3,254,814 | 6/1966 | Weir et al. | 223/89 |

FOREIGN PATENT DOCUMENTS

| | | | |
|---|---|---|---|
| 468766 | 10/1950 | Canada | 223/92 |
| 1067721 | 12/1952 | France | 223/92 |
| 527504 | 3/1955 | Italy | 223/92 |
| 558022 | 2/1957 | Italy | 223/89 |

*Primary Examiner*—Bibhu Mohanty
*Attorney, Agent, or Firm*—Meschkow & Gresham, P.L.C.

[57] ABSTRACT

A clothes hanger (10) has a base (16) and shoulder pieces (18) which slidable couple to the base (16). A suspending member (20) rotatably couples to the base (16). The base (16) is wide and is shaped to roughly conform to the human body in the vicinity of the neck and shoulders. A texturized top surface (28) resists garment slippage. The shoulder pieces (18) have an inner section (46) and an outer section (48). The inner section (46) engages a receiving region (40) of the base (16). A knob (58) on the inner section (46) engages one of several holes (56) in the base to secure the shoulder piece (18) in a selected position relative to the base (16).

3 Claims, 3 Drawing Sheets

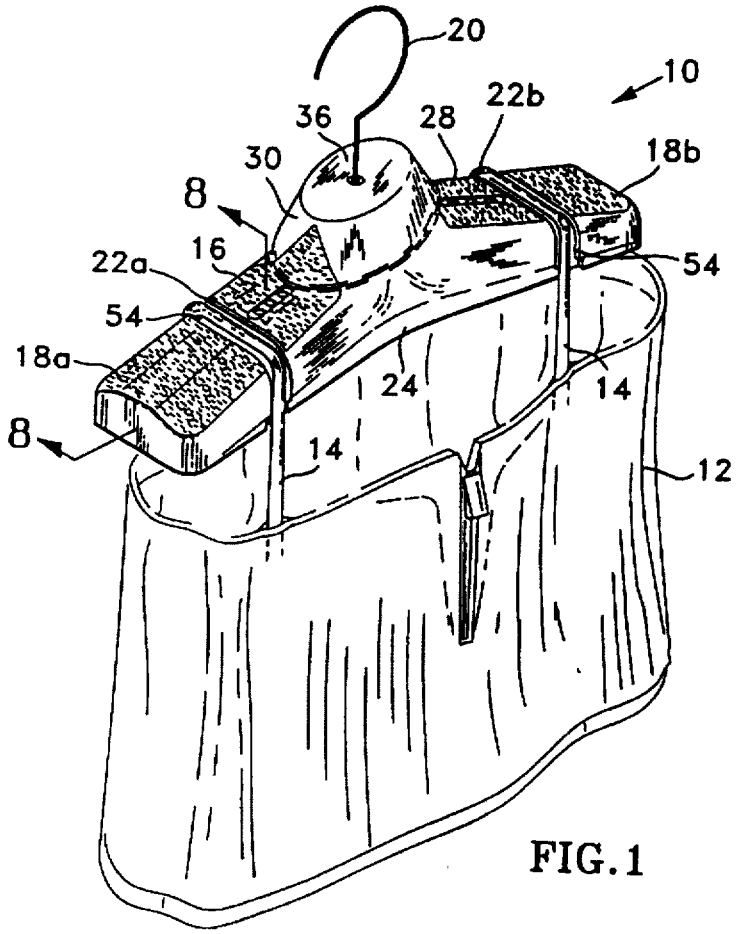
FIG. 1
FIG. 2
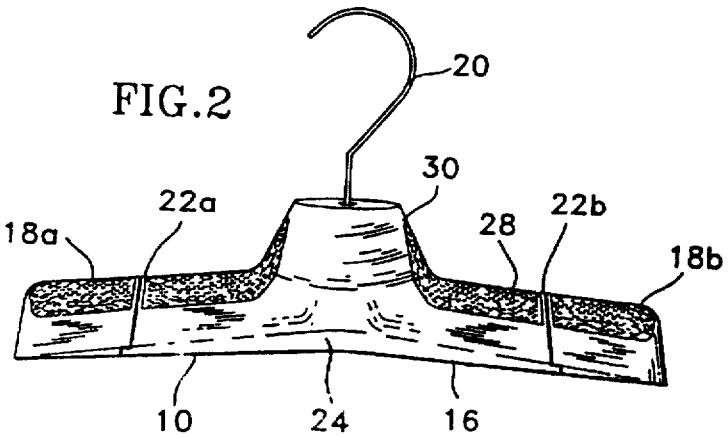
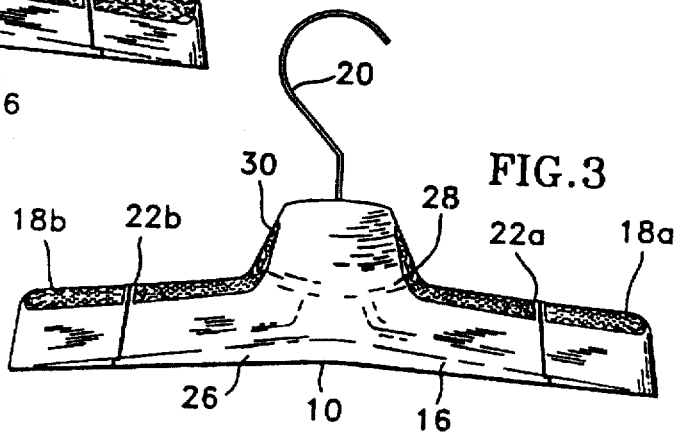
FIG. 3

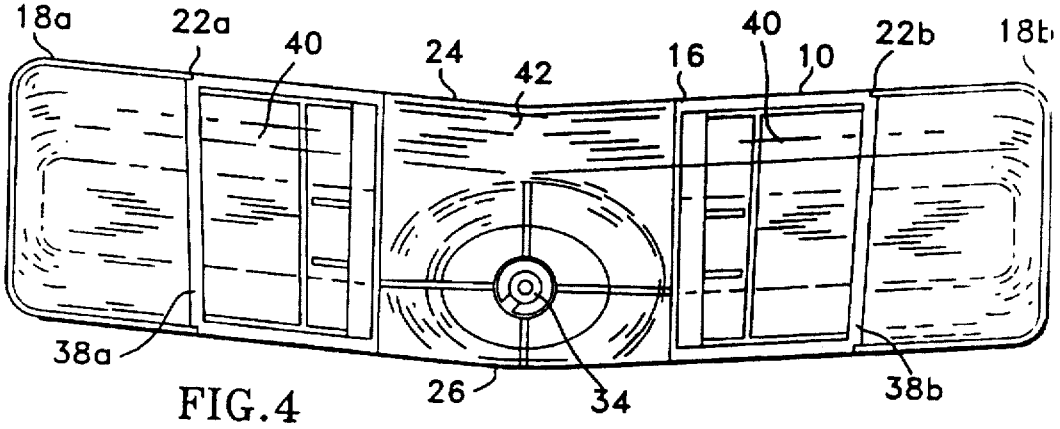
FIG.4
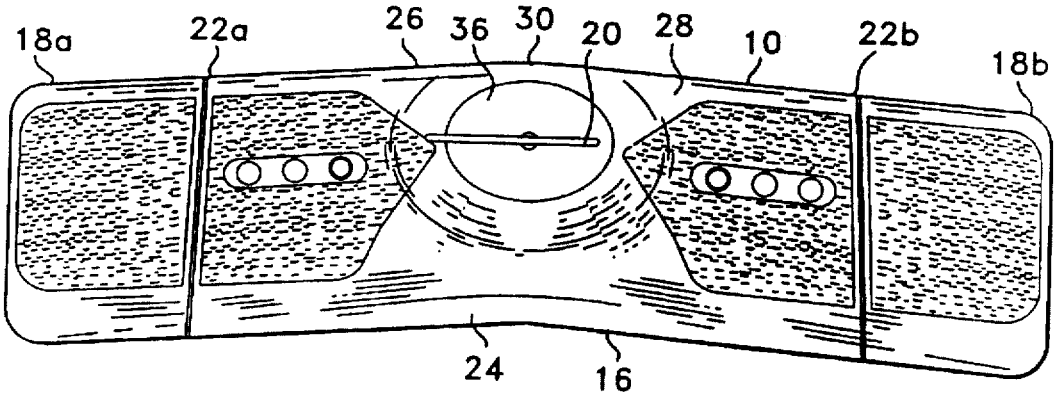
FIG.5
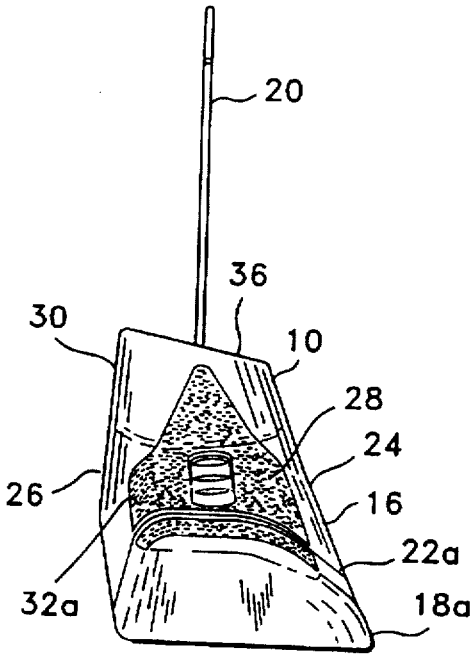
FIG.6
FIG.7
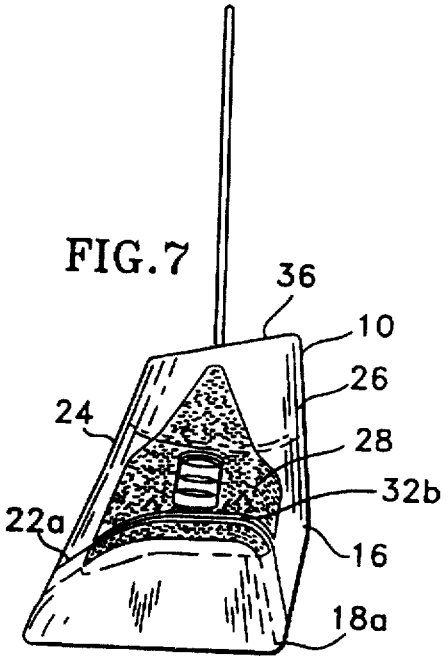

EXTENSIBLE CLOTHES HANGER

This application is a continuation of application Ser. No. 08/277,099, filed Jul. 20, 1994 now abandoned.

TECHNICAL FIELD OF THE INVENTION

The present invention relates generally to devices from which clothes are hung. More specifically, the present invention relates to clothes hangers which can adapt to clothing articles of varying size and configuration.

BACKGROUND OF THE INVENTION

Clothing which is worn over the torso and arms of the human body comes in a wide variety of shapes and sizes. On the other hand, hangers from which such clothing may be hung typically come in a relatively small variety of shapes and sizes. Consequently, an item of clothing is often hung from a hanger that may not conform to the shape and size of the item of clothing. In such situations, the item does not hang on the hanger as it does from its intended human body. One viewing the item of clothing on a hanger does not get a realistic impression of how the item will appear on a person. In addition, the item of clothing is at risk of becoming permanently distorted by the hanger, such as by creasing, or by over stressing localized areas of the clothing fabric.

The problem of hangered clothing failing to present a realistic impression of how the clothing will appear on a person is very serious to clothes merchandisers. The seriousness of this problem forces stores that sell clothes to use mannequins for display purposes. Mannequins do a good job of providing a realistic impression of how clothing will appear on a person. However, mannequins are expensive, take up valuable retail space, and consume precious employee time in mannequin dressing and undressing activities. Consequently, retail stores typically display only a small fraction of their clothing using mannequins, and many clothing stores do not use mannequins at all.

The problem of an item of clothing becoming distorted due to hanging from an incompatible hanger is particularly troublesome when the shoulder of the garment does not match the shoulder portion of the hanger. If the hanger is too small for the garment, distortion may result when garment shoulders droop off the edges of the hanger. If the hanger is too large for the garment, distortion may produce unwanted wrinkles. This distortion problem becomes worse as garments become heaver. Overcoats, sweaters, and sweatshirts are particularly prone to such distortions.

Owners of sweaters and sweatshirts are frequently advised not to dry these items in dryers. But, hanging such wet items produces significant distortion in the shoulders and arms of the garment. Due to this problem, these sweaters and sweatshirts are frequently laid on flat surfaces to dry, where they are in the way of other activities, they take up valuable space often needed for other purposes, and they are at risk of becoming soiled.

Of course, conventional hangers could be provided in a variety of sizes so that better compatibility between garments and hangers may be achieved by selecting a proper size hanger. However, this is an undesirable solution. Users tend to resist hunting for a more appropriately sized hanger when they have another hanger at hand. Consequently, they tend to use inappropriately sized hangers even though more appropriately sized hangers may be available.

SUMMARY OF THE INVENTION

Accordingly, it is an advantage of the present invention that an improved clothes hanger is provided.

Another advantage of the present invention is that a clothes hanger with an extensible shoulder piece is provided.

Another advantage is that a clothes hanger is provided which adapts to clothing articles of varying size and configuration.

Another advantage is that a clothes hanger provides improved realism in obtaining an impression of how clothing will appear on a person.

Another advantage is that a clothes hanger reduces the risks of distorting clothing.

Another advantage is that a clothes hanger which approaches the desirable presentation characteristics of a mannequin is provided at far less cost in money, space, and time.

The above and other advantages of the present invention are carried out in one form by a clothes hanging apparatus which adapts to clothing articles of varying size and configuration. The apparatus comprises a base having first and second opposing ends. An extensible shoulder piece movably couples to the first base end.

BRIEF DESCRIPTION OF THE DRAWINGS

A more complete understanding of the present invention may be derived by referring to the detailed description and claims when considered in connection with the Figures, wherein like reference numbers refer to similar items throughout the Figures, and:

FIG. 1 shows a perspective view of an extensible clothes hanger configured in accordance with the teaching of the present invention;

FIG. 2 shows a front elevation view of the hanger;

FIG. 3 shows a back elevation view of the hanger;

FIG. 4 shows a bottom plan view of the hanger;

FIG. 5 shows a top plan view of the hanger;

FIG. 6 shows a first end elevation view of the hanger;

FIG. 7 shows a second end elevation view of the hanger;

Figure 8:
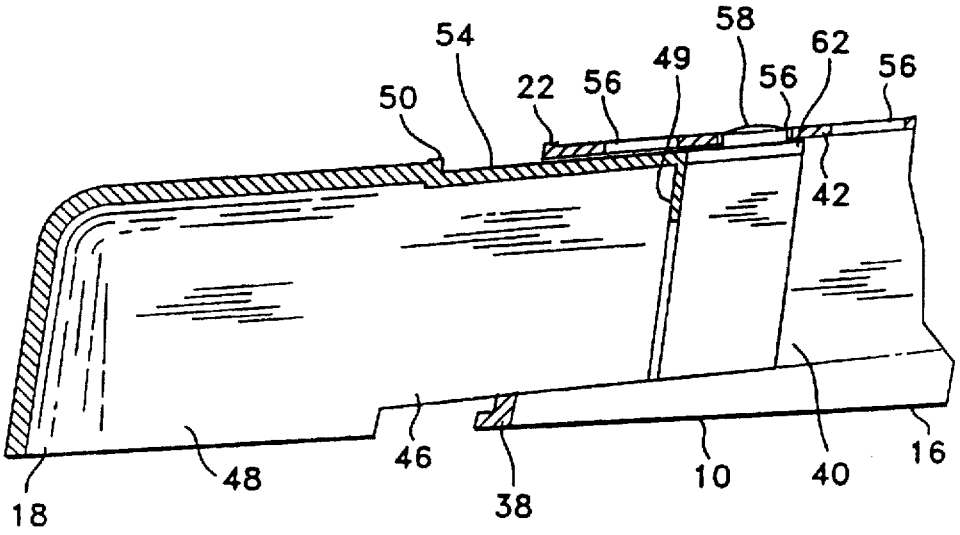
FIG. 8 shows a cross-sectional side view of a shoulder piece of the hanger in cooperation with a hanger base.

In the following description of preferred embodiments, certain items are either identical to or mirror images of other items. This description distinguishes such items from their counterparts by the use of the lower case alphabetic characters "as" and "b" which are appended to a common reference number. When an alphabetic character is omitted, the description refers to any one of such items and their counterparts individually or to all of them collectively.

DETAILED DESCRIPTION OF THE PREFERRED EMBODIMENTS

FIG. 1 shows a perspective view of an extensible clothes hanger 10 from which a garment 12 hangs by straps 14. FIG. 1 illustrates a garment which hangs by straps because such a garment permits clear illustration of the details of hanger 10. Those skilled in the art will appreciate that any garment may hang from hanger 10, including garments intended to be worn over the torso and/or arms of a person, such as shirts, blouses, overalls, dresses, coats, jackets, sweaters, sweatshirts, and the like.

Hanger 10 includes a base 16, shoulder pieces **18*a* and 18*b*, and a suspending member 20**, which takes the form of a conventional hanger hook in the preferred embodiment.

Shoulder pieces 18*a* and 18*b* slidably couple to ends 22*a* and 22*b*, respectively, of base 16. Shoulder pieces 18 may slide outward from base 16 to extend the length of hanger 10 or slide inward to shrink the length of hanger 10. Thus, a user may adapt hanger 10 to conform to varying shoulder sizes of a different garments 12.

In the preferred embodiments, base 16, and shoulder pieces 18 are individual items which are molded from a suitable plastic. Suspending member 20 is desirably formed from steel or another rigid material.

FIG. 2 shows a front elevation view of hanger 10, FIG. 3 shows a back elevation view of hanger 10, FIG. 4 shows a bottom plan view of hanger 10, FIG. 5 shows a top plan view of hanger 10, FIG. 6 shows a first end elevation view of hanger 10, and FIG. 7 shows a second end elevation view of hanger 10. Referring generally to FIGS. 1–7, base 16 has opposing front and back sides 24 and 26, respectively, which extend between ends 22. A top surface 28 also extends between ends 22. A majority of the surface area of top surface 28 is texturized in the molding process so that garments 12 on hanger 10 are restrained from slipping. However, front and back sides 24 and 26 are preferably not texturized so that a garment may more freely slide over these surfaces and become evenly distributed around hanger 10.

A central region 30 of base 16 resides between ends 22. Front and back sides 24 and 26 and top surface 28 all extend through central region 30. As best seen in FIGS. 2 and 3, central region 30 extends above ends 22, and gently curves toward ends 22. This slope roughly simulates the slope of a human body from the neck to the shoulders. In addition, as best seen in FIGS. 4 and 5, front and back sides 24 and 26, respectively, are curved to simulate the natural curve of a human body from the back around to the shoulders. In particular, at front side 24, central region 30 extends slightly inward. At back side 26, central region 30 extends slightly outward.

As best seen in FIGS. 4–7, hanger 10 is thick so that it simulates the thickness of a human body from front to back at the shoulders. In the preferred embodiments, hanger 10 is at least 2½" between front and back sides 24 and 26, and more preferably at least 3¼". However, practical considerations limit the maximum thickness. If hanger 10 is made too thick, then the number of hangers 10 which may reside in a given closet or shelf space becomes limited. Consequently, thicknesses in the range of 2½" to 4 " are a desirable compromise.

Not only does the thickness of hanger 10 simulate the thickness of a human body, but this thickness expands the area over which the entire weight of a garment 12 is supported. Since the garment weight is distributed over a larger area, the chances of over stressing localized areas of the garment are reduced, as are the changes of a garment becoming distorted from hanging on hanger 10. Due at least in part to this thickness of hanger 10, wet garments such as sweaters and sweatshirts may be hung on hanger 10 for drying without risk of garment distortion.

FIGS. 6 and 7 specifically reveal the cross sectional shape of hanger 10 in the vicinity of ends 22. Back side 26 slopes steeply upward to uppermost points 32*a* and 32*b* at ends 22*a* and 22*b*, respectively. Uppermost points 32 reside closer to back side 26 than to front side 24. From uppermost points 32, top surface 28 slopes more gently downward and forward toward front side 24. The shapes of shoulder pieces 18 conform to these slopes. This shape simulates the top surface of the human body at the shoulders. Consequently, the shape of hanger 16 roughly conforms to the shape of the human body in the vicinity of the neck and shoulders. Moreover, the slope from uppermost points 32 to front side 24 encourages a garment to slide toward front side 24 more than to back side 26 in response to jostling. Garments which open down the front tend to remain in place on hanger 10 rather than to slide back toward back side 26. Backward sliding would be undesirable because it could lead to a distorted garment shape or to the garment sliding off.

Suspending member 20 attaches to base 16 at central region 30. As shown in FIG. 4, suspending member 20 is retained in place by a retainer 34 that desirably allows suspending member 20 to freely rotate. Top surface 28 in the vicinity of central region 30 includes an elliptically shaped flat portion 36 that slopes from a higher point at back surface 26 downward toward front surface 24. Suspending member 20 couples to base 16 in the center of flat portion 36. Flat portion 36 provides a place where labels and other printed materials can successfully attach or otherwise be formed and viewed, even when garments are hanging on hanger 10. As best viewed in FIGS. 4 and 5, suspending member 20 couples to base 16 nearer to back surface 26 than to front side 24. This offset orientation tends to cause hanger 10 to cant or rotate from its single suspension point in a direction which urges a hanging garment to slide forward, toward front side 24. Thus, a garment tends to slide forward and remain in place when jostled, rather than sliding backward where it might slide off hanger 10.

Base 16 desirably forms a bottomless hollow shell. However, pivot bars 38*a* and 38*b* (see FIG. 4) extend across the bottom of base 16 at ends 22*a* and 22*b*, respectively. The hollow portion of base 16 forms receiving regions 40*a*and 40*b* near ends 22*a* and 22*b*, respectively. Receiving regions 40 are surrounded in the front, back, and top by an interior surface 42 of base 16. Interior surface 42 is the inside front and back sides 24 and 26, respectively, and the inside of top surface 28. In the preferred embodiment, walls of base 16 exhibit a relatively constant thickness, and interior surface 42 has a shape similar to that described above for base 16 generally.

Figure 9:
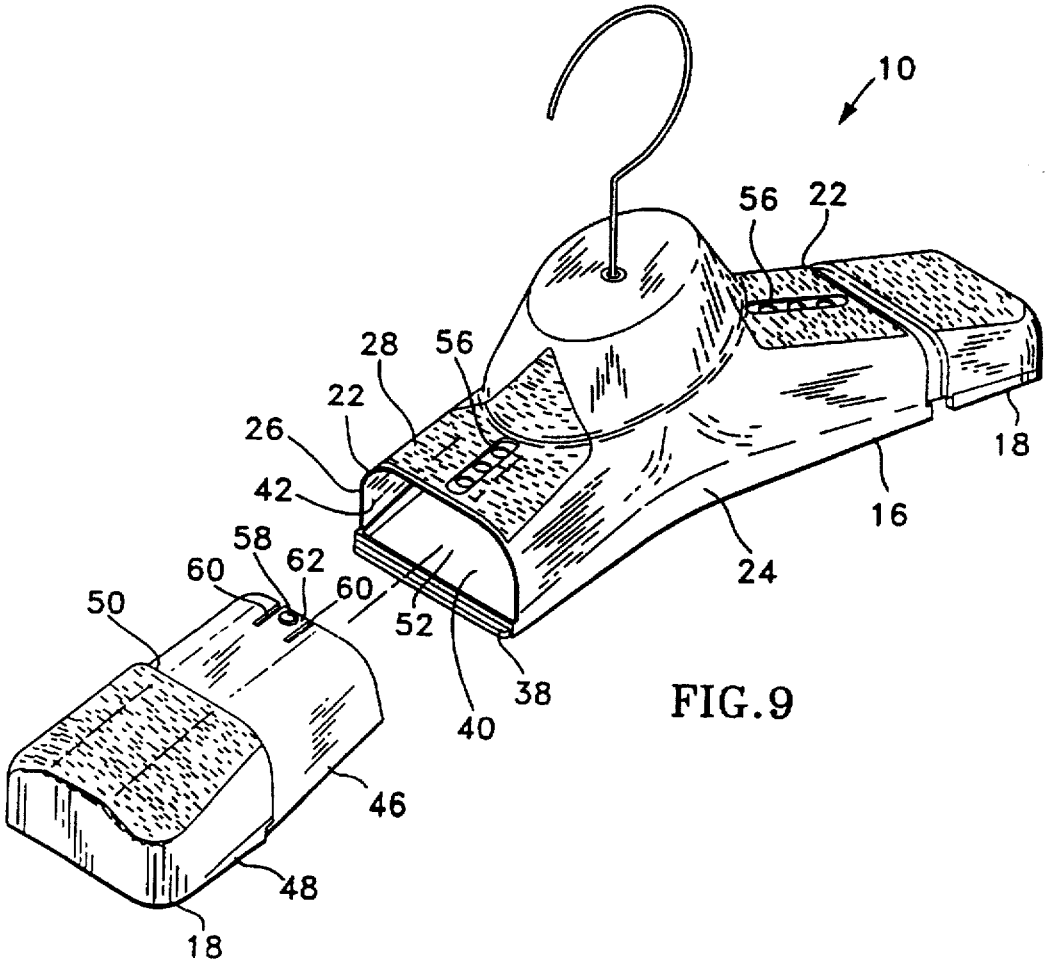
FIG. 9 shows a perspective view of the shoulder piece removed from the hanger base.

FIGS. 8 and 9 illustrate the cooperation between shoulder pieces 18 and base 16. Both of shoulder pieces 18 operate in a similar manner. Generally, shoulder pieces 18 slidable engage base 16 at receiving region 40 (see FIG. 4) and are secured at a desired position through a mating action between securing parts located in base 16 and shoulder pieces 18. In the preferred embodiment, the securing parts are integrally molded with base 16 and with shoulder pieces 18.

Shoulder piece 18 includes an inner section 46 and an outer section 48. Inner and outer sections 46 and 48 are molded together as an integral unit having a junction 50 between inner and outer sections 46 and 48. The shape and size of outer section 48 conforms to the shape and size of base 16 at end 22. The top of outer section 48 is texturized to resist garment slippage, and the exterior ends of outer section 48 are desirably gently rounded. The bottom of inner section has a transverse reinforcing member 49 to enhance the rigidity of shoulder piece 18.

Front side 24, back side 26, top surface 28, and pivot bar 38 together surround an opening 52 in end 22 of base 16. Inner section 46 of shoulder piece 18 is dimensioned to fit through opening 52, but outer section 48 is too large to fit through opening 52. Thus, inward movement of shoulder piece 18 stops when junction 50 abuts end 22 of base 16. The shape of inner section 46 conforms to the shape of interior surface 42 so that shoulder piece 18 smoothly slides into and out from receiving region 40 of base 16. The outer surface of inner section 46 is not texturized to promote slippage of inner section 46 against interior surface 42.

As shown in FIGS. 1 and 8, the smaller size of inner section 46, compared to outer section 48 and base 16 and end 22 causes a channel 54 to form when shoulder piece 18 is extended. For garments which hang by straps, such as garment 12 shown in FIG. 1 which hangs by straps 14, channel 54 retains straps 14 so that the garment 12 does not slide off hanger 10.

The securing part for base 16 in the preferred embodiments includes three aligned holes 56 formed through top surface 28 to interior surface 42. The alignment of holes 56 extends from proximate one of ends 22 toward the other of ends 22, and holes 56 are provided at each of ends 22.

The securing part for shoulder piece 18 is a knob 58 which projects outwardly from inner section 46 toward holes 56. Knob 58 is dimensioned to engage any one of holes 56. Slots 60 on opposing sides of knob 58 allow knob 58 to flex toward and away from holes 56. However, knob 58 extends upward from a tab 62 which is integrally molded with shoulder piece 18. Tab 62 is a resilient member that urges knob 58 to an undisturbed position.

As inner section 46 of shoulder piece 18 slides into receiving region 40, knob 58 is deflected downward by interior surface 42, and the resilience of tab 62 urges knob 58 upward. As inner section 46 continues to slide into receiving region 40, knob 58 encounters one of holes 56, and moves upward to engage the hole 56 in response to the urging influence of resilient tab 62. Shoulder piece 18 is secured in a most extended position relative to base 16. To slide shoulder piece 18 further inward, one may push inward on shoulder piece 18 so that knob 58 pops out of the detent provided by hole 56. Knob 58 may also be pushed downward from top surface 28 to ease the effort required to pop knob 58 out of its detent. Continued sliding will cause knob 58 to engage the second and/or third of holes 56.

Accordingly, shoulder pieces 18 may be extended to a desired position relative to base 16 and secured in place as knobs 58 engage nearby holes 56. When a garment is placed on hanger 10, a portion of the garment weight hangs on outer sections 48, urging inner sections 46 to pivot upward about pivot bars 38 in response to the garment weight on the opposing side of pivot bars 38. This further insures that shoulder pieces 18 remain in their desired positions relative to base 16.

In summary, the present invention provides an improved clothes hanger. The clothes hanger of the present invention includes an extensible shoulder piece. The extensible shoulder piece, along with other hanger features, allows the hanger to adapt to clothing articles of varying size and configuration. The hanger shape simulates the shape of a human body in the vicinity of the neck and shoulders. Thus, the clothes hanger provides improved realism in obtaining an impression concerning how clothing will appear on a person. In addition, the adjustable nature and size of the hanger reduces the risks of distorting clothing. The hanger provides many of the desirable presentation characteristics of a mannequin at far less expense, lowered space requirements, and reduced dressing time.

The present invention has been described above with reference to preferred embodiments. However, those skilled in the art will recognize that changes and modifications may be made in these preferred embodiments without departing from the scope of the present invention. For example, relative orientational terms, such as top, bottom, front, back, above, below, uppermost, and the like, are used herein for convenience, for consistency with the Figures, and for consistency with normal usage. However, the present invention requires no absolute orientation. In addition, while specific desirable shapes have been described herein, those skilled in the art will appreciate that such shapes may be modified to meet the demands of specific applications. These and other changes and modifications which are obvious to those skilled in the art are intended to be included within the scope of the present invention.

What is claimed is:

1. A clothes hanging apparatus which adapts to clothing articles of varying size and configuration, said apparatus comprising:

a base having first and second opposing ends, front and back sides, a top surface extending between said first and second ends, and a pivot member between said front and back sides, said base being configured so that said front and back sides, said pivot member, and said top surface surround an opening into a receiving region;

a suspending member extending upward from said top surface; and an extensible shoulder piece movably coupled to said first base end, said shoulder piece being configured to slide through said opening into said receiving region and configured to pivot about said pivot member to engage said first base end;

wherein said extensible shoulder piece includes an inner section that is configured to slide through said opening into said receiving region;

wherein said base has first and second holes formed into said top surface; and wherein said inner section of said shoulder piece has an outwardly projecting knob configured to engage said holes.

2. A clothes hanging apparatus as claimed in claim 1 wherein said knob is configured to move in a direction substantially perpendicular to said top surface to permit selectable engagement of one of said holes with said knob.

3. A clothes hanging apparatus as claimed in claim 1 wherein said base additionally has a third hole formed into said top surface, said third hole being aligned with said first and second holes.

* * * * *